US006312580B1

(12) United States Patent
Antelman

(10) Patent No.: US 6,312,580 B1
(45) Date of Patent: Nov. 6, 2001

(54) METHOD FOR GOLD PLATING CHROMIUM AND OTHER PASSIVE METALS

(75) Inventor: Perry W. Antelman, Providence, RI (US)

(73) Assignee: Tivian Industries, Ltd., East Povidence, RI (US)

( * ) Notice: Subject to any disclaimer, the term of this patent is extended or adjusted under 35 U.S.C. 154(b) by 0 days.

(21) Appl. No.: 09/184,361

(22) Filed: Nov. 2, 1998

(51) Int. Cl.[7] ..... C25D 5/06
(52) U.S. Cl. ..... 205/117; 205/178; 205/268
(58) Field of Search ..... 205/266, 267, 205/268, 178, 117

(56) References Cited

U.S. PATENT DOCUMENTS 4,046,644 * 9/1977 Liska ..... 205/266
4,168,214 * 9/1979 Fletcher et al. ..... 205/268
4,212,708 * 7/1980 Smagunova et al. ..... 205/267
4,606,795 * 8/1986 Ruiz et al. ..... 205/117
5,169,514 * 12/1992 Hendriks et al. ..... 205/247

FOREIGN PATENT DOCUMENTS

1082695 * 9/1967 (GB) .

OTHER PUBLICATIONS

F. Lowenheim, "Electroplating", McGraw–Hill, Inc. 19878, pp 266–268, 270 and 271.*

* cited by examiner

*Primary Examiner*—Kishor Mayekar
(74) *Attorney, Agent, or Firm*—Salter & Michaelson

(57) ABSTRACT

A method is described for plating adherent, hard decorative gold in one or two steps, eliminating multistage substrate stripping on chromium plated automobile emblems.

10 Claims, No Drawings

METHOD FOR GOLD PLATING CHROMIUM AND OTHER PASSIVE METALS

BACKGROUND OF THE INVENTION

The present invention relates to a method for plating gold on chromium and particularly onto the passive plated chromium services of automobile emblems,and one step.

Chromium electroplated deposits exhibit a bright, silver-like luster, and are used extensively for plating automobile bumpers and hardware, e.g., plumbing fixtures, which exploit the decorative "white" luster of this hard and corrosion-resistant metal. Thus one authority on chromium plating has stated, "thin coatings serve as a non tarnishing, durable surface finish" with respect to decorative plating; and "heavy coatings are used to take advantage of the special properties of chromium, including resistance to heat, wear corrosion, and erosion, and low coefficient of friction" (George Dubpernell, *Modem Electroplating*, Frederick Lowenheim, Editor, John Wiley 1974 p.87) with respect to hard industrial finishes. However, it is the passivity of chromium which increases its resistance to chemical attack. While this is a desirable property for chromium as a final finish, it makes the surface extremely difficult to plate, as, for example, when gold decorative finishes are desired.

The state of the art until now precluded the direct plating of chromium and passive alloys, e.g., stainless 'stools with gold, in one step. Two or three steps were required depending on the process. One method involves stripping chromium anodically with caustic soda solution, activating the under layer of nickel plate exposed by removing the chromium with acid, followed by gold plating. A second process involves chromium stripping with 10–15% sulfuric acid. Both processes are extremely time consuming and difficult to execute as the plater has difficulty in discerning when the chromium has been entirely removed. Should residual chromium be left, there will be poor adhesion of the subsequent gold finish which will have a marred blotchy appearance. Stainless-steel parts, on the other hand, require a nickel or gold strike prior to gold plating, and there is difficulty in determining when there is a sufficient layer of nickel to suffice as a viable deposit.

The substrates chosen by the instant inventor were those used for gold plating automobile emblems, where the problem has been extant for many years, with either chromium-plated or stainless-steel emblems. After experimenting with various chemical compositions, the proper formulation was achieved which enabled the instantaneous plating of gold onto said chromium-plated substrates in one step. The resultant gold plate exhibited an excellent appearance, integrity of finish, outstanding adhesion and abrasion resistance. The preferred gold solution was a proprietary hard-acid gold solution introduced into the marketplace in 1993 called "Tivaglo-86" (trademark of Tivian Industries, Ltd.) for heavy gold plating up to 80 microinches. The gold solution is described in U.S. Pat. No. 5,575,900 of which the instant inventor is the co-inventor. The time of the multistage processes previously described is about an hour per automobile, while the instant invention's one-step process took several minutes. Furthermore, the multistage processes generated hazardous metal-bearing waste, especially with toxic chromium.

OBJECTS OF THE INVENTION

The main object of the invention is to plate gold in one step onto passive metal substrates, exemplary of which are chromium and stainless steel alloys, in such a manner as to yield a decorative gold finish with a variety of advantageous functional properties. Among the other objects of the invention are the individual functional properties.

Thus another object of the invention is to provide a gold finish with a rich 24-carat yellow color as differentiated from brassy-colored gold finishes.

Still another object of the invention is to provide for a gold finish exhibiting surface integrity and continuity with no visible imperfections.

Still another object of the invention is to provide a gold finish which will not detach from the passive chromium metal substrate surface and which exhibits superior adhesion.

Still another object of the invention is to achieve a gold finish which is sufficiently hard enough to meet the abrasion-resistance standards of those skilled in the art.

It should be realized that the aforementioned preceding four functional objectives of said invention should be achieved in one step on the aforesaid exemplary passive substrates.

The final object of the invention is to provide a method for gold plating passive chromium surfaces without generating hazardous wastes, especially toxic chromium.

Other objects, features and advantages of the invention shall become apparent as the description thereof proceeds herein.

SUMMARY OF THE INVENTION

A method is described for decorative gold plating on passive chromium plated automobile emblems in one step, in one step. While the functional exemplary accomplishment of said invention has been achieved with brush plating apparatus on automobile emblems, it should be realized that the exemplary employment of said process in no way limits the method to automobile emblems, and is to be broadly construed as to be applicable for plating gold on all passive metal surfaces. Likewise the employment of brush plating apparatus is not intended to constrict this invention only to brush plating and should be applicable to all types of electroplating.

Gold can be plated directly on automobile emblems composed of stainless steel, or which have a final chromium metal finish, in one step without the necessity of prior activation or metallic stripping of said emblems. The one-step process involves plating with an acid gold plating solution having a pH from 0.1 to 4.5 which contains from 0.5–3 troy ounces of gold per gallon. The preferred gold salt is potassium gold cyanide while the preferred gold plating solution is "Tivaglo-86", a product of the instant assignee described in U.S. Pat. No. 5,575,900 of which the instant inventor is co-inventor. However, it should be noted that in said U.S. gold solution the patent reference is made (column 1, line 42 and column 3, lines 63–66) to the gold solutions of Duva and Rinker (U.S. Pat. No. 2,905,601) which are incapable of acidities below pH of 2.5. Accordingly, said commercial solutions which incorporate Duva-Rinker electrolytes are incapable of acting in this manner despite the fact that they are "acid gold" solutions.

Gold may be applied by brush plating onto a clean chromium-plated automobile emblem. The plating may be done directly on the emblem while it is attached to the automobile. Accordingly, the emblem is made cathodic utilizing a DC power supply in which the saturated gold brush is anodic. Gold deposited as prescribed exhibits surface integrity, a rich 24-karat yellow color, abrasion resistance, as well as strong adhesion to the emblem's surface. It has been found that should the pH be raised over 4.0, adhesion decreases inversely with the pH. The preferred gold concentration is 1 to 2 troy ounces per gallon. The pH of "Tivaglo-86", the preferred gold solution of this invention, is below 2.0, and its gold concentration is 1.0 troy ounces per gallon. However any heavy acid gold solution exhibiting similar properties to "Tivaglo-86" may be utilized and will become part of the however method of this invention. The one-step process reduces the time of about one hour per automobile to about 10 minutes. Furthermore, this method generates no hazardous metallic wastes, especially highly toxic carcinogenic chromium waste. Accordingly, when assignee's proprietary cleaner, "Activator T", is used to activate chromium surfaces, plating is instantaneous, and there is no hazardous stripping waste generated even though the process is technically a two-step process.

As this invention may be embodied in several forms without departing from the spirit or essential characteristics thereof, the afore described embodiment is therefore illustrative and not restrictive, since the scope of the invention is defined by the appended claims rather than by the description preceding them, and all changes that fall within the metes and bounds of the claims or that form their functional as well as cojointly cooperative, equivalents, are therefore intended to be embraced by these claims.

What is claimed:

1. A method for brush plating 24 karat gold onto a passive chromium surface of automobile emblems which have been electro deposited, in one step; by electroplating with an acid gold plating solution comprising:

a) a soluble alkali metal complex salt of gold wherein the gold concentration is in the range of 2 pennyweights to 3.0 troy ounces of gold per gallon; and b) an acid electrolyte where an adjusted pH range of the solution varies from 0.1 to 3.0.

2. The plating method of claim 1 wherein the pH range of 0.1 to 2.0 enables the deposition of hard gold deposits exhibiting superior substrate adhesion.

3. The plating method of claim 1 wherein the gold concentration in solution is in the range of 2 to 4.8 pennyweights of gold per gallon.

4. The plating method of claim 1 wherein the gold deposit is a rich 24-karat yellow color as differentiated from brassy-colored gold finishes.

5. The plating method of claim 1, which eliminates the generation of hazardous wastes that exist in multistage processes.

6. The plating method of claim 5 which does not necessitate the addition of a salt of a platable alloying metal to the solution.

7. The plating method of claim 1, wherein the gold deposit will not detach from the chromium surface.

8. The plating method of claim 1 wherein the gold deposit is hard and exhibits no visible surface imperfections.

9. The plating method of claim 1, wherein the electroplating is performed on the passive chrome surface in the absence of a surface treatment to activate the passive surface or to remove the chrome surface.

10. Method for electrodepositing a layer of gold onto an automobile emblem having an electroplated passive chrome surface, comprising the steps of:

providing an automobile emblem having a passive chrome surface; and brush electroplating the passive chrome surface using a gold plating solution, the gold plating solution comprising a gold concentration ranging from about 0.1 to less than about 4 pennyweights of gold per gallon and a pH ranging from about 0.1 to about 4.5;

wherein the electroplating is performed on the passive chrome surface in the absence of a surface treatment to activate the passive surface or to remove the chrome surface.

* * * * *